US006765601B2

(12) United States Patent
Nishi et al.

(10) Patent No.: US 6,765,601 B2
(45) Date of Patent: Jul. 20, 2004

(54) THERMAL PRINTHEAD

(75) Inventors: Kouji Nishi, Kyoto (JP); Takaya Nagahata, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/248,772

(22) Filed: Feb. 17, 2003

(65) Prior Publication Data

US 2004/0119785 A1 Jun. 24, 2004

(30) Foreign Application Priority Data

Dec. 20, 2002 (JP) ..... 2002-369211

(51) Int. Cl.[7] ..... B41J 2/32; B41J 2/345
(52) U.S. Cl. ..... 347/171; 347/208
(58) Field of Search ..... 347/171, 208, 347/200, 204–205, 206–207, 209, 62

(56) References Cited

U.S. PATENT DOCUMENTS 6,424,367 B1 * 7/2002 Obata et al. ..... 347/208
6,441,840 B1 * 8/2002 Sato et al. ..... 347/208
6,452,621 B1 * 9/2002 Nakamura ..... 347/208
6,517,194 B2 * 2/2003 Suzuki ..... 347/62

* cited by examiner

*Primary Examiner*—K. Feggins
(74) *Attorney, Agent, or Firm*—Shinjyu Global IP

(57) ABSTRACT

A thermal printhead is disclosed which prevents an undesired color from being generated around the periphery of a desired color, even when a two-color thermo-sensitive paper is used as the recording medium. A plurality of variable electric potential regions are formed on top of a heating resistor. Each region is disposed between two adjacent projections, and has an individual electrode that intersects therewith. The variable electric potential regions generate colors due to electric potential differences that are produced between a common electrode and individual electrodes. The width of each variable electric potential region corresponds to one dot, and is set such that the temperature of the entire region is substantially uniform when heated. A plurality of fixed electric potential regions are formed on top of the heating resistor, and each region has a fixed electric potential even when an electric potential difference is produced between the common electrode and the individual electrodes. Each adjacent pair of fixed electric potential regions have at least one variable electric potential region disposed therebetween.

19 Claims, 17 Drawing Sheets

THERMAL PRINTHEAD

BACKGROUND OF THE INVENTION

1. Field of the Invention

This invention generally relates to a thermal printhead that is used to print images onto recording paper by means of thermo-sensitive printing or thermal ink-transfer printing.

2. Background Information

FIG. 16 shows an example of a conventional thermal printhead. This thermal printhead includes a common electrode 163, individual electrodes 164, and a belt shaped heating resistor 165, all of which are disposed on top of an insulating substrate 161. The common electrode 163 includes a belt shaped common line 163*b*, and a plurality of projections 163*c* that project out from the common line 163*b* like the teeth of a comb. Each first end 164*a* of each individual electrode 164 is interposed between two adjacent-projections 163*c*. Each individual electrode 164 and each projection 163*c* intersect with the heating resistor 165 and are in electrical contact therewith. Note that, although not shown in the figures, a terminal is formed on one end of the common line 163*b* of the common electrode 163, and the common electrode 163 is connected to a voltage application means via this terminal. In addition, terminals are formed on second ends of each individual electrode 164 (not shown in the figures). These terminals are each connected to drive IC chips that serve to independently apply a voltage to each individual electrode 164.

In a thermal printhead constructed in this manner, for example, a positive voltage is applied to the common electrode 163 while one individual electrode 164 is connected to ground. An electric potential difference is produced in a region H on the heating resistor 165 that is disposed between two adjacent projections 163*c* and which has a grounded individual electrode 164 that intersects therewith. Electricity flows through the region H and generates heat therein, thereby allowing a one dot (one pixel) image to be printed on a thermo-sensitive type of recording paper.

However, in the thermal printhead noted above, it is well known that the temperature distribution on each region H will not be uniform when heated up. In other words, it is well known that the central portions between the individual electrode 164 and the adjacent projections 163*c* will be the hottest, and that the temperature will drop as one moves away from the central portions. The temperature difference between the ends of each region H and the central portions thereof will be more pronounced as the size of each region H increases. This creates a problem in that when using a two-color thermo-sensitive paper as a recording medium for thermal printheads, it is easy to produce colors other than those intended.

For example, when one uses a black/red two-color thermo-sensitive paper and attempts to print a one dot image that is entirely black thereon, the temperature differentials on each region H on the heating resistor 165 causes a large red image to be printed around the periphery of the black image. Note that a two-color thermo-sensitive paper used with thermal printheads is paper which turns a first color (e.g., black) when at or above a predetermined temperature, and turns a second color (e.g., red) at a temperature lower than the predetermined temperature.

Furthermore, increasing the temperature of not only the central portions of each region H but the end portions and their vicinity to a predetermined temperature suitable for printing tends to require a great deal of electrical energy, and thus a great deal of electrical power will be consumed by the thermal printhead. Reducing the size of each region H is thought to be one means for controlling the amount of electrical power consumed. This is because the amount of energy needed can be reduced if the size of the regions H are reduced, even though the regions H are heated up to the predetermined temperature.

However, in the thermal printhead shown in FIG. 16, all of the regions along the length of the heating resistor 165 are capable of generating heat except for both ends thereof. Because of this, when one attempts to reduce the width of the regions H by reducing the array pitch W of the projections 163*c* of the common electrode 163, it will be necessary to increase the total number of projections 163*c* and individual electrodes 164. Thus, although the print image resolution will increase, the task of forming the patterns for the common electrode 163 and the individual electrodes 164 will be more difficult. Furthermore, the number of drive IC chips for applying a voltage to the individual electrodes 164 must be increased, and thus the cost of manufacturing the thermal printhead will increase. In addition, if the size of one dot is reduced, the heat capacity of each region H will be reduced, and thus there is a concern that the temperature of each region H will increase higher than necessary when that region is heated up, due to the effect of the temperature of other regions H adjacent thereto, and that thermal degradation will occur.

SUMMARY OF INVENTION

An object of the present invention is to provide technology for preventing undesirable colors from being generated around the periphery of a desired color even when a two-color thermo-sensitive paper is used as a recording medium.

Another object of the present invention is to make uniform the temperature distribution of a region corresponding to one dot of a heating resistor employed in a thermal printhead.

Another object of the present invention is to reduce the amount of electrical power consumed by a thermal printhead while preventing the manufacturing costs thereof to increase.

In order to solve the aforementioned problems, a thermal printhead according to the present invention is employed to print images on a thermo-sensitive paper. According to a first aspect of the present invention, a thermal printhead is comprised of:

a substrate;

a belt shaped heat resistor disposed on top of the substrate;

a common electrode having a common line disposed along a longitudinal direction of the heat resistor, and a plurality of projections that each project from the common line and which intersect with and electrically connect to the heat resistor; and a plurality of individual electrodes that are each disposed between mutually adjacent projections which intersect with and electrically connect to the heat resistor.

In this thermal printhead, when an electric potential difference is produced between the individual electrodes and projections of the common electrode, a plurality of regions that have a substantially fixed electric potential (fixed electric potential regions) are formed on the heating resistor in positions in which at least one variable electrical potential region is disposed therebetween. Here, the variable electric potential regions are regions on the heating resistor that are disposed between adjacent pairs of projections and which have an individual electrode that intersects therewith.

The common electrode may be any shape that allows a fixed electric potential regions to be produced on the heating resistor when a voltage is applied between the common electrode and an individual electrode. For example, a fixed electric potential region can be formed between two projections on the heating resistor. In another example, wide projections can be formed, and the portions thereof that are in contact with the heating resistor can form the fixed electric potential regions.

According to another aspect of the present invention, the temperatures of the variable electric potential regions are higher than the fixed electric potential regions when an electric potential difference is produced between the common electrode and the individual electrodes.

An electric potential difference is produced on both ends of each variable electric potential region when an electric potential difference is produced between the common electrode and the individual electrodes. Due to this electric potential difference, electricity flows to the variable electric potential regions and heats these regions up, and the variable electric potential region will become a heat generating region. On the other hand, electricity does not flow to the fixed electric potential regions, and thus these regions will become non-heat generating regions.

According to another aspect of the present invention, the fixed electric potential regions are sized such that a variable electric potential region adjacent to one side of each fixed electric potential region does not have a substantial impact on the temperature of the variable electric potential region on the other side of each fixed electric potential region.

By providing each fixed electric potential region with sufficient width, it will be difficult for the variable electric potential regions to affect each others temperature. Thus, the variable electric regions can be prevented from becoming too hot.

According to another aspect of the present invention, the thermo-sensitive paper is a two-color thermo-sensitive paper that produces a first color at a temperature Tp1 or above, and produces a second color between a temperature Tp2 and the temperature Tp1 (Tp2<Tp1). Here, the size of the variable electric potential regions are set such that the entire area of each has the temperature Tp1 or above.

For example, when a two-color thermo-sensitive paper the produces black and red colors is used a recording medium, the variable electric potential regions are sized such that the entire area of each region is at or above a temperature that produces a black color. Note that in this case, it is preferable that the size of each fixed electric potential region is set such that the temperature of each does not substantially exceed Tp2. There will be a change in temperature between the variable electric potential regions and the fixed electric potential regions, and thus a red image can be prevented from being generated around the periphery of a black image.

According to another aspect of the present invention, the portions of the heating resistor that are disposed between two adjacent projections are fixed electric potential regions.

Shaping the common electrode such that portions of the heating resistor are disposed between two adjacent projections is one way of shaping the common electrode to generate fixed electric potential regions.

According to another aspect of the present invention, a bridge connects the two projections on either side of each fixed electric potential region.

A number of benefits can be obtained by forming a bridge between the two projections on either side of each fixed electric potential region. For example, even in situations in which one projection is broken near its base, a fixed electric potential region can still be formed if the tip of the broken portion is connected to the other projection via a bridge.

According to another aspect of the present invention, the portions of the heating resistor that are in electrical contact with the projections of the common electrode are the fixed electric potential regions.

The portions of the heating resistor that are in electrical contact with the projections will become the fixed electric potential regions if the projections have a certain width. Thus, electrical resistance will be reduced, and the formation of the common electrode pattern will be simplified, because the projections have a wide width.

According to another aspect of the present invention, each projection on the common electrode is in electrical contact with the heating resistor at a plurality of points thereon, and the portions of the heating resistor which are interposed between the plurality of points are the fixed electric potential regions.

For example, each projection can be brought into contact with the heating resistor at a plurality of points thereon by branching the projection or by making each projection non-linear.

According to another aspect of the present invention, the tip of each projection on the common electrode is branched. Here, each branch of each projection intersects with and is electrical contact with the heating resistor, and the portions of the heating resistor that are interposed between the branches are fixed electric potential regions.

Compared to a configuration in which narrow projections project from the common line and contact with the heating resistor, forming a relatively thick projection and then branching out narrow branches that contact with the heating resistor is advantageous because it is easier to form the common electrode and electrical resistance will be reduced.

According to another aspect of the present invention, bridges are formed to connect the branches that sandwich each fixed electric potential region.

Similar to that noted above, a fixed electric potential region can be formed even in situations in which one branch is broken at its base.

According to another aspect of the present invention, each projection on the common electrode is non-linear, and intersects with and is in electrical contact with the heating resistor at a plurality of points thereon. Here, the portions of the heating resistor that are interposed between the plurality of points on the projections are the fixed electric potential regions.

Because the projections are non-linear in shape, it will be difficult for the heat of the variable electric potential regions to escape to the common electrode, thus allowing one to control the power consumption of the thermal printhead.

According to another aspect of the present invention, the individual electrodes are branched. Here, the branches of each individual electrode are disposed such that one projection is interposed therebetween, and intersect with and electrically contact with the heating resistor.

Because a plurality of variable electric potential regions that each correspond to one dot can be formed on the heating resistor, it becomes easy to make the temperature of each of these regions uniform.

According to another aspect of the present invention, a thermal printhead is comprised of:

a substrate;

a belt shaped heat resistor disposed on top of the substrate:

a common electrode having a common line disposed along a longitudinal direction of the heat resistor, and a plurality of projections that each project from the common line and which intersect with and electrically contact with the heat resistor; and a plurality of individual electrodes that are each disposed between mutually adjacent projections and which intersect with and electrically contact with the heat resistor.

Here, a plurality of regions on the heat resistor are comprised of a plurality of heat generating regions that are electrically connected to the Individual electrodes, and at least one non-heat generating region disposed between each pair of the plurality of heat generating regions and not electrically connected to the individual electrodes.

According to another aspect of the present Invention, the plurality of projections are spaced apart from each other at a predetermined distance, and the plurality of heat generating regions and the plurality of non-heat generating regions are arranged on the heating resistor such that one heat generating regions alternates with one non-heat generating region.

According to another aspect of the present Invention, the heat generating regions and the non-heat generating regions have different widths.

According to another aspect of the present invention, the plurality of heat generating regions and the plurality of non-heat generating regions are arranged on the heating resistor such that one heat generating region alternates with a plurality of non-heat generating regions.

According to another aspect of the present invention, a thermal printhead is comprised of:

a substrate:

a belt shaped heat resistor disposed on top of the substrate;

a common electrode having a common line disposed along a longitudinal direction of the heat resistor, and a plurality of projections that each project from the common line and which intersect with and electrically contact with the heat resistor; and a plurality of individual electrodes that are each disposed between mutually adjacent projections and which intersect with and electrically contact with the heat resistor, each individual electrode comprising a first end, a second end, and a terminal disposed on the second end.

Here, the total number of terminals is less than the total number of first ends, and each terminal is electrically connected to two or more first ends that are electrically connected to mutually adjacent regions on the heat resistor.

According to another aspect of the present invention, a plurality of first ends branch out from each individual electrode.

According to another aspect of the present invention, mutually adjacent groups of the plurality of individual electrodes share one terminal.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF DRAWINGS

Referring now to the attached drawings which form a part of this original disclosure:

FIG. 3(*b*) is a cross-sectional view of the thermal printhead taken along the line Y–Y' shown in FIG. 2:

FIG. 12(*b*) shows a modification of the eighth embodiment of the thermal printhead shown in FIG. 12(*a*);

FIG. 12(*c*) shows another modification of the eighth embodiment of the thermal printhead shown in FIG. 12(*a*);

FIG. 13(*b*) shows the thermal properties of the ninth embodiment of the present invention shown in FIG. 13(*a*):

FIG. 13(*c*) shows a modification to the thermal printhead shown in FIG. 13(*a*);

FIG. 14(*b*) shows a modification to the thermal printhead shown in FIG. 14(*a*);

FIG. 15(*b*) shows a modification to the thermal printhead shown in FIG. 15(*a*)

DETAILED DESCRIPTION

Preferred embodiments of the present invention are described in detail below with reference to the figures.

1. First Embodiment

A. Overall Structure

Figure 1:
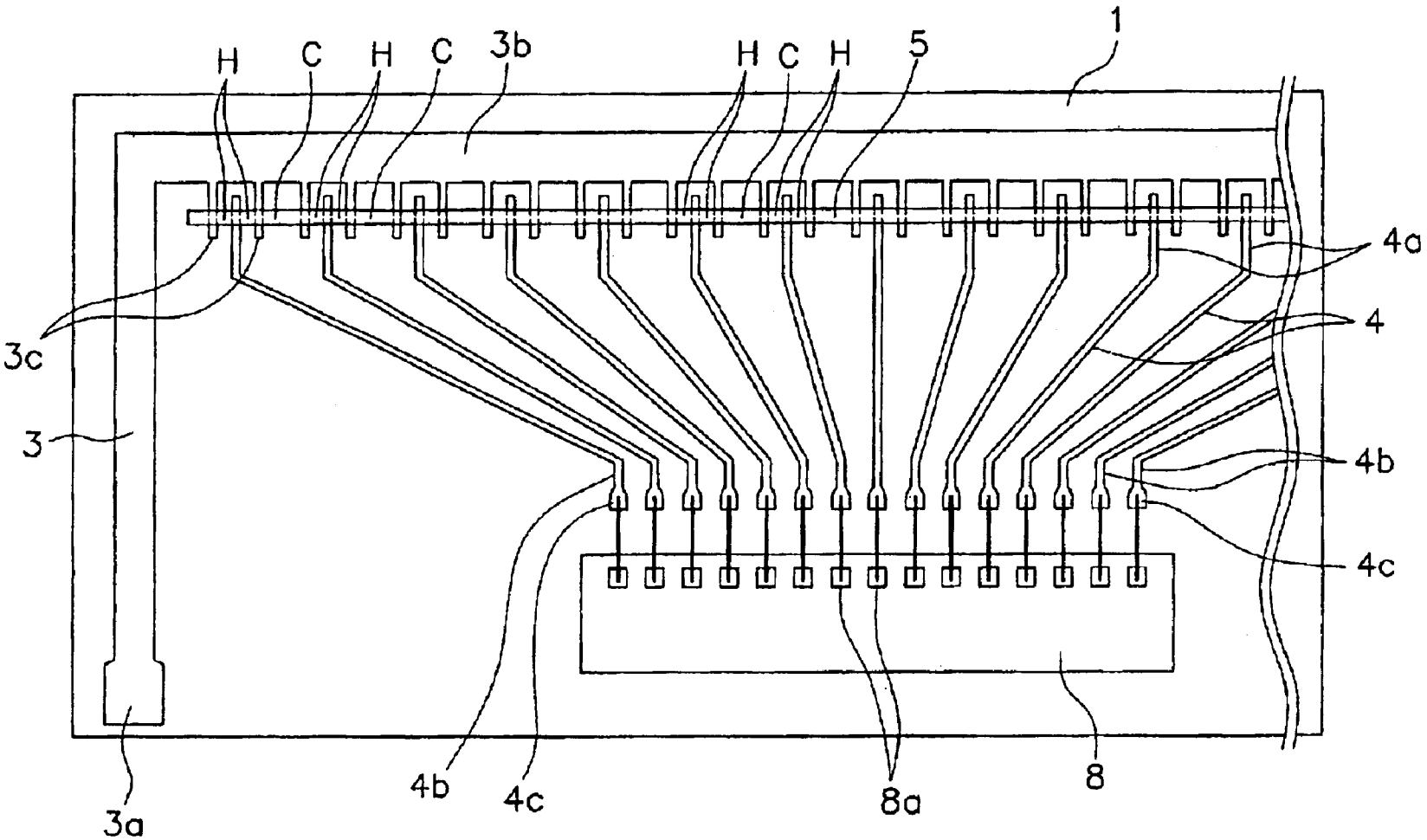
FIG. 1 shows the overall structure of a thermal printhead according to a first embodiment of the present invention.
Figure 2:
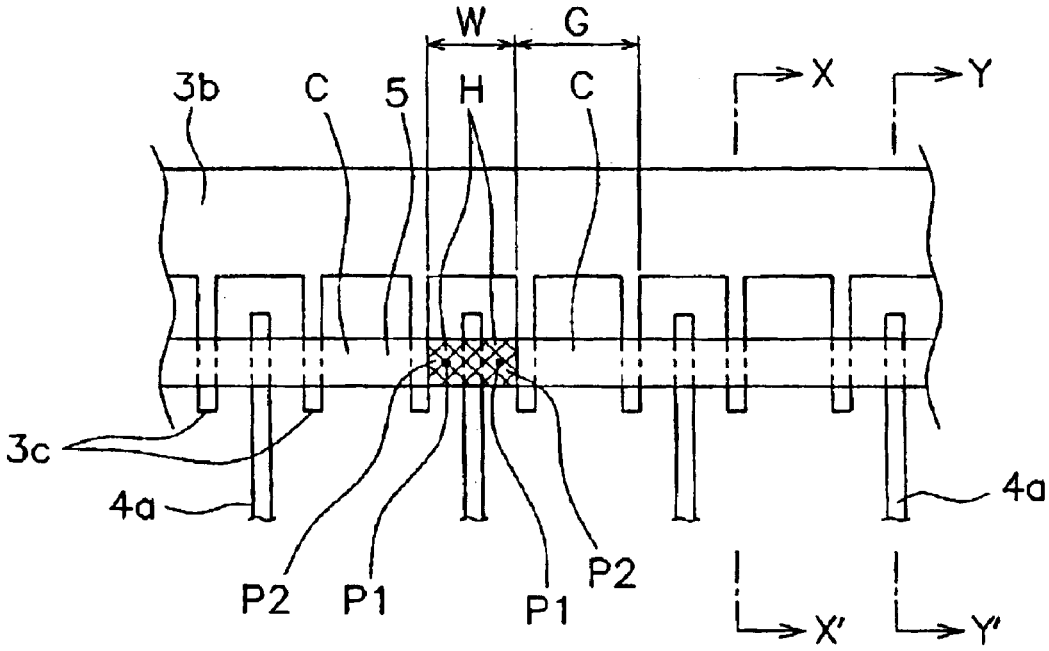
FIG. 2 shows details of the thermal printhead shown FIG. 1.
Figure 3A:
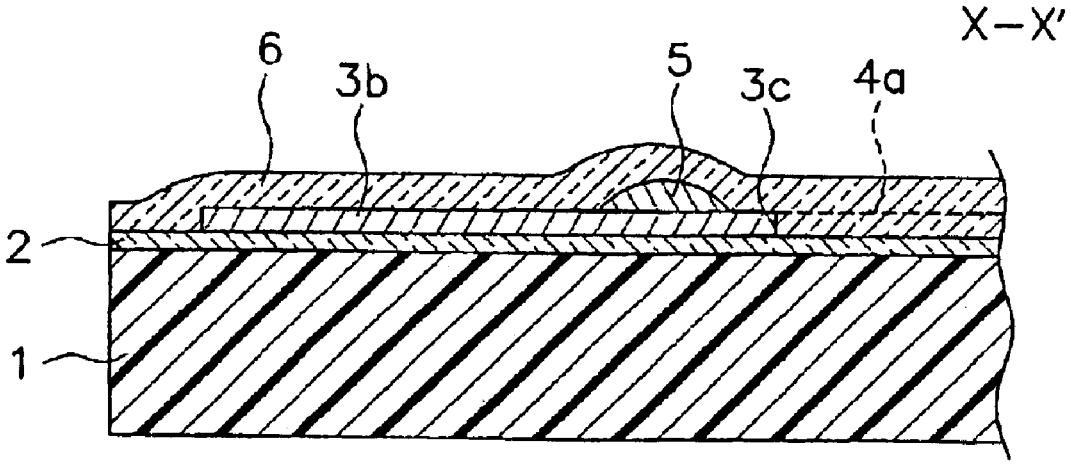
FIG. 3(*a*) is a cross-sectional view of the thermal printhead taken along the line X–X' shown in FIG. 2.
Figure 3B:
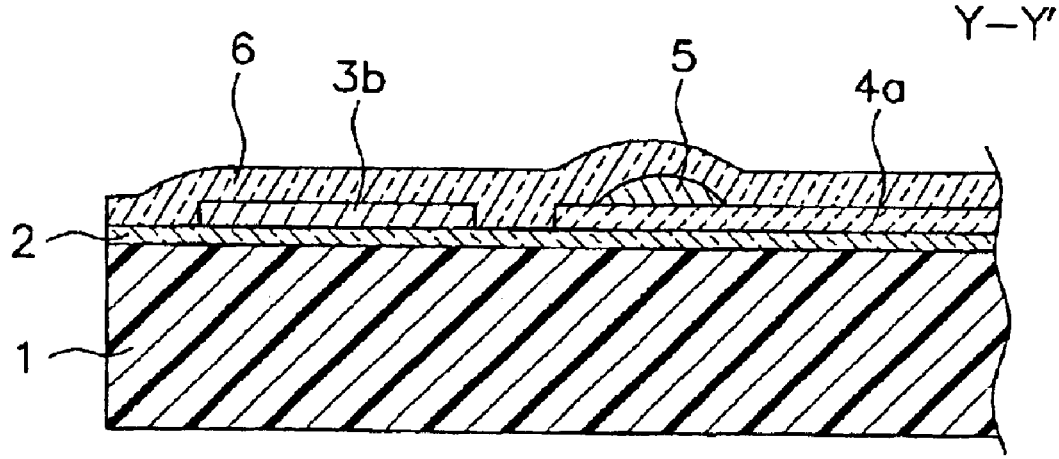

FIG. 1 shows the structure of a thermal printhead according to a first embodiment of the present invention. FIG. 2 shows details of the thermal printhead shown in FIG. 1. FIG. 3(*a*) is a cross-section of the thermal printhead shown in FIG. 2, taken along the line X–X', and FIG. 3(*b*) is a cross-section of the thermal printhead shown in FIG. 2, taken along the line Y–Y'. As can be seen in FIGS. 1 and 3, the thermal printhead of the present embodiment is formed by sequentially laminating a glaze layer 2, a common electrode 3, a plurality of individual electrodes 4, a heat resistor 5, and a protective layer 6 on a upper surface of a substrate 1. An IC chip 8 is mounted on top of the substrate 1.

The substrate 1 is, for example, an alumina ceramic type of insulating substrate having a long rectangular shape that extends in a fixed direction. The glaze layer 2 (shown in FIG. 3) is primarily composed of glass, and is formed over approximately the entire surface of the substrate 1. The glaze layer 2 acts as a thermal storage layer, and both smoothes the surface that is formed by the common electrode 3 and the individual electrodes 4 and acts to increase their adhesive strength.

The common electrode 3 can be formed from a conductive film such as copper and the like. A common line 3*b* is disposed along the length of the heating resistor 5. A plurality of projections 3*c* project from the common line 3*b*, and each projection 3*c* intersects with and is in electrical contact with the heating resistor 5. The plurality of projections 3*c* are shaped so as to produce regions on the heating resistor 5 in which the electric potential thereon is fixed (hereinafter referred to as fixed electric potential regions C) when an electric potential difference is produced between the common electrode 3 and the individual electrodes 4. In addition, the projections 3*c* are shaped so that at least one variable electric potential region H (described in detail below) will be disposed between two fixed electric potential regions C. In the example shown in FIGS. 1 and 3, the projections 3*c* project from the common line 3*b*, and are uniformly spaced thereon like the teeth of a comb. In addition, a terminal 3*a* is formed on one end of the common line 3*b*. A positive voltage, for example, is applied to the terminal 3*a* by a voltage application means not shown in the figures.

Each individual electrode 4 includes a first end 4*a*, a second end 4*b* that is on the side opposite the first end 4*a*, and a terminal 4*c* that is formed on each second end 4*b*. The same material that is used to form the conductive film of the common electrode 3 can be used to form the individual electrodes 4. Each of the first ends 4*a* of the individual electrodes 4 extend between mutually adjacent projections 3*c*, and intersect with the heating resistor 5 and are in electrical contact therewith. The variable electric potential regions H are defined as the regions on the heating resistor 5 which are disposed between two adjacent projections 3*c* and which have a first end 4*a* of an individual electrode 4 that intersects therewith. Each first end 4*a* of the individual electrodes 4 is disposed between two projections 3*c*, and spaced with respect to each other such that one or a plurality of variable electric potential regions H are disposed between two fixed electric potential regions C. In this embodiment, the individual electrodes 4 are arranged such that two projections 3*c* are disposed between two individual electrodes 4. Each terminal 4*c* is formed on each second end 4*b* of the individual electrodes 4. A voltage is independently applied to each individual electrode 4 via the terminals 4*c* by means of the drive IC chip 8.

The heat resistor 5 is arranged in a belt-like manner such that it intersects with the projections 3*c* and the first ends 4*a* of the individual electrodes 4. The heating resistor 5 is in electrical contact with the projections 3*c* and the individual electrodes 4 at the points where It intersects with each projection 3*c* and each first end 4*a* of the individual electrodes 4. The variable electric potential regions H and the fixed electric potential regions C are formed on top of the heating resistor 5. Details on the variable electric potential regions H and the fixed electric potential regions C will be provided below. The heat resistor 5 can be formed, for example, by printing and baking a thick film resistive paste in which ruthenium oxide is the conductive component.

The protective layer 6 is formed by printing and baking, for example, a glass paste. The protective layer 6 acts to coat and protect the individual electrodes 4 and the heating resistor 5.

The drive IC chip 8 includes internal circuits (not shown in the figures) and a plurality of electrodes 8*a*. The internal circuits serve to receive print image data and control the heat driver of the heat resistor 5 based upon the print image data received. The electrodes 8*a* are electrically connected to the terminals 4*c* of the individual electrodes 4. Either one or a plurality of the terminals 4*c* can be selectively grounded by the drive IC chip 8. Note that for the sake of simplifying the figures, the respective number of the electrodes 8*a* of the drive IC chip 8, the individual electrodes 4, and the projections 3*c* of the common electrode 3 shown in the figures is less than actually used in the present invention. However, in actual practice one IC chip 8 is multi-bit, e.g., 32 bit or 64 bit, and thus capable of on/off control of the voltages for the plurality of the individual electrodes 4.

B. Variable Electric Potential Regions H

The variable electric potential regions H are the regions on the heating resistor 5 which extend between two adjacent projections 3*c* and are intersected by each first end 4*a* of the individual electrodes 4. A voltage is applied to these regions H by means of an electric potential difference produced between the common electrode 3 and the individual electrodes 4. When a voltage is applied to the variable electric potential regions H, they become heat generating regions whose temperatures are higher than those of other regions on the heating resistor 5 due to the electric current that flows thereto.

In this embodiment, one variable electric potential region H forms one dot. It is preferable that the width W of one dot (here, the width of a variable electric potential region H) be set such that the temperature of the entire region H will be substantially uniform when heated. For example, consider a situation in which a two-color (black and red) thermo-sensitive paper is used as a recording medium. This two-color thermo-sensitive paper produces a black image at a temperature Tp1 or above, and produces a red image between a temperature Tp2 and temperature Tp1 (Tp2<Tp1). In this situation, the width W of a variable electric potential region H should be set such that the temperature of the entire region H will be at Tp1 or above when a voltage is applied to the region H. Moreover, although the central portions P1 of a variable electric potential region H are easy to heat to a high temperature, it is comparatively difficult to raise the temperature of the neighboring portions P2 and ends of the region H to the same high temperature. Thus, it is preferable that the width W be set such that the temperature of the neighboring portions P2 and ends of the regions H reaches Tp1 or above. In other words, the width W should be set such that the temperature of the portion of the heating resistor 5 that corresponds thereto is substantially uniform. In this way, it will be easy to prevent a large image having an undesired color from being formed around the periphery of a black dot. Note also that one variable electric potential region H is defined herein as a region which includes the pair of heat generating regions formed on both sides of one individual electrode 4.

C. Fixed Electric Potential Regions C

The fixed electric potential regions C are the regions on the heating resistor 5 in which the electric potential therein is maintained at a fixed level even if an electric potential difference is produced between the common electrode 3 and the individual electrodes 4. The fixed electric potential regions C are formed on the heating resistor 5 such that at least one variable electric potential region H is disposed between two fixed electric potential regions C. In the present embodiment, the fixed electric potential regions C are the regions on the heating resistor 5 which are disposed between two projections 3*c* of the common electrode 3. These regions C are non-heat generating regions whose temperatures are lower than those of the variable electric potential regions H, because a voltage Is not applied to them even if an electric potential difference is produced between the common electrode 3 and the individual electrodes 4.

It is preferable that an interval G between the variable electric potential regions H (here, a width G of the fixed electric potential regions C) be set such that the temperature of one variable electric potential region H is not affected by the temperature of another variable electric potential region H. If the interval G is too narrow, the temperature of the variable electric potential regions H on either side of a fixed electric potential region C will affect each other, and thus there Is a concern that the temperature of the regions H will increase to a level that is higher than necessary and cause thermal degradation. In addition, by providing the fixed electric potential regions C with sufficient width, it will be difficult for the temperature of the fixed electric potential regions C themselves to affect the temperature of the variable electric potential regions H. Moreover, when using a two-color (black and red) thermo-sensitive paper as a recording medium, it will be easy to keep the temperature of the fixed electric potential regions C below the temperature Tp2 that produces a red image. As a result, the temperature between the variable electric potential regions H and the fixed electric potential regions C will modulate, thus allowing colors other than the ones intended from being generated. In addition, the ease of forming patterns for the projections 3*c* and the individual electrodes 4, the image resolution, and the cost of manufacturing the thermal printhead, should all be taken into consideration when setting the intervals G.

D. Effects

In the thermal printhead formed as described above, variable electric potential regions H and fixed electric potential regions C are formed on the heating resistor 5. This prevents the total number of variable electric potential regions H from increasing while allowing the widths W to be reduced. Thus, the variable electric potential regions H can be reduced in size, and the difference between the highest temperature and the lowest temperature on a variable electric potential region H can be reduced. For example, even when a two-color (black and red) thermo-sensitive paper as a recording medium is used, the generation of a red image around the periphery of a black image caused by a difference in temperatures can be prevented.

In addition, it now becomes possible to heat the variable electric potential regions H to a temperature that Is higher than the lowest necessary temperature, because the thermal impact that a pair of variable electric potential regions H will have on each other will be reduced by the fixed electric potential regions C. Thus, not only will the aforementioned generation of undesirable colors be eliminated, but an adequate amount of heat can be transmitted to and a clear Image can be printed on both the first and second pages of a two-ply, duplicate-type of thermo-sensitive paper.

In addition, the amount of electrical energy needed to heat one variable electric potential region H can be reduced, which thus reduces the amount of power consumed by the entire thermal printhead, because size of the variable electric potential regions H can be reduced. Furthermore, it will be difficult for the heat of each variable electric potential region H to affect the heat of the other variable electric potential regions H, because the thermal impact of a pair of variable electric potential regions H is reduced by a fixed electric potential region C.

Moreover, even if the size of the variable electric potential regions H are reduced, the total number of variable electric potential regions H can be prevented from increasing due to the formation of the fixed electric potential regions C, and likewise the total number of individual electrodes 4 can be prevented from increasing. Thus, it will be easier to form the patterns for the individual electrodes 4, and there will be no increase in the cost of producing thermal printheads because there is no increase in usage of drive IC chips.

2. Second Embodiment

Figure 4:
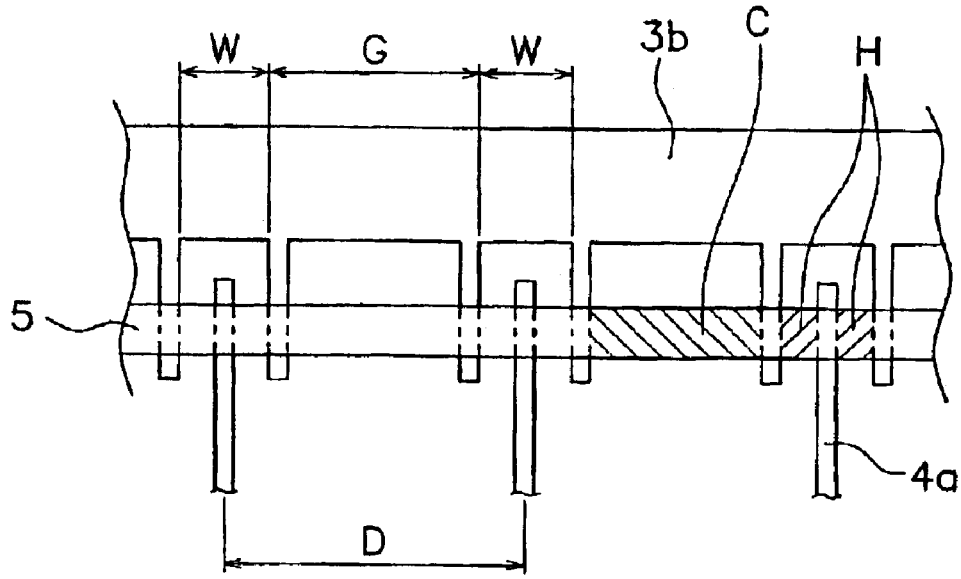
FIG. 4 shows the structure of a thermal printhead according to a second embodiment of the present invention.
Figure 5:
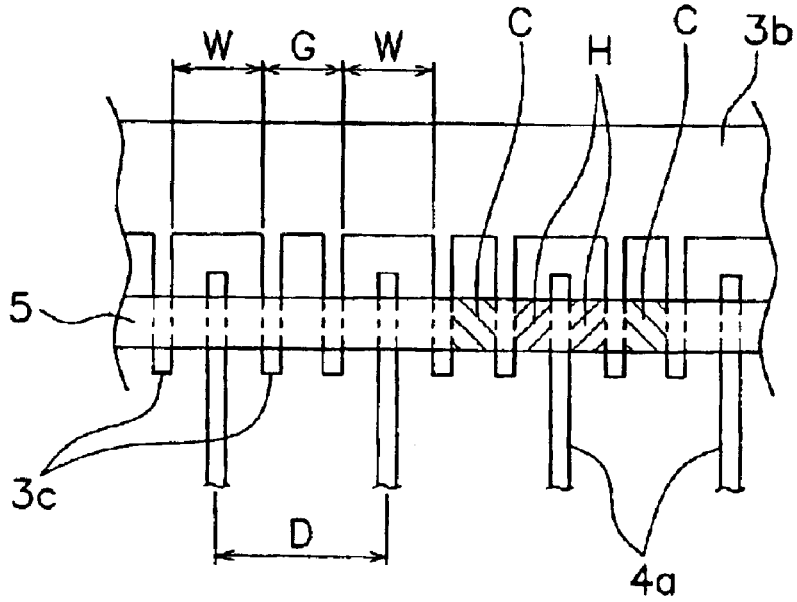
FIG. 5 shows the structure of a thermal printhead according to a modification of the second embodiment of the present invention.

FIGS. 4 and 5 shows some of the elements of a thermal printhead according to a second embodiment of the present invention. The thermal printhead according to this embodiment has a structure that is identical with that of the first embodiment, except for the size of the width W of each variable electric potential region H that forms one dot, and the size of the interval G between adjacent variable electric potential regions H. In the present embodiment, the intervals between the projection 3*c* of the common electrode are not all the same. The intervals between the projection 3*c* are the width W of each variable electric potential region H and the interval C, however this pattern is constant. Note also that intervals D between each first end 4*a* of the individual electrodes 4 are constant.

In FIG. 4, the width W of each variable electric potential region H is formed to be narrower than the interval G between a pair of variable electric potential regions H. In FIG. 5, this relationship is reversed. The width W of each variable electric potential region H and the interval G between pairs thereof is not particularly limited. The width W of each variable electric potential region H is, as noted above, set so that the temperature of the entire region will become substantially uniform when heated. In addition, the interval G between a pair of variable electric potential regions H is, as noted above, set so that the thermal Impact that a pair of variable electric potential regions H have on each other will be reduced. Furthermore, the interval G is set so that the temperature of each fixed electric potential region C will not substantially exceed a temperature Tp2 due to the affect of the variable electric potential regions H thereon. When a two-color thermo-sensitive paper is used as the recording medium, and that paper generates a first color at a temperature Tp1 or higher, and generates a second color between a temperature Tp2 and Tp1 (Tp2<Tp1), the temperature Tp2 is the lowest temperature at which the second color will be generated.

Note that the effects of the thermal printhead according to this embodiment are identical to those of the first embodiment.

3. Third Embodiment

Figure 6:
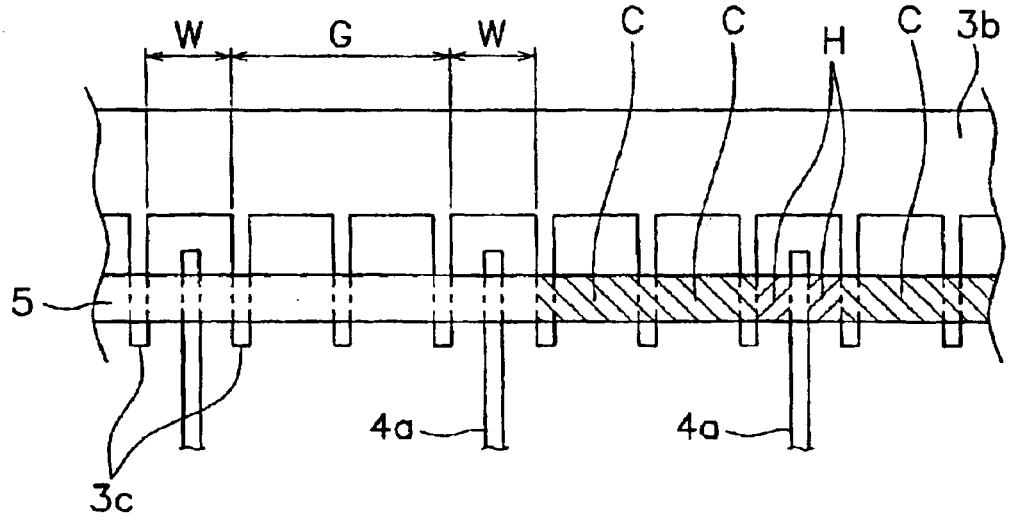
FIG. 6 shows the structure of a thermal printhead according to a third embodiment of the present invention.

FIG. 6 shows some of the elements of a thermal printhead according to a third embodiment of the present invention. The thermal printhead according to this embodiment has a structure that is identical with that of the first embodiment, except for the interval between the first ends 4*a* of the individual electrodes 4. In this embodiment, the first ends 4*a* of the individual electrodes 4 are disposed such that three projections 3*c* of the common electrode are disposed between each set of two first ends 4*a*. In other words, the individual electrodes 4 are disposed such that two fixed electric potential regions C are formed between two variable electric potential regions H. As can be clearly seen in the first embodiment and the present embodiment, the number of projections 3*c* disposed between the first ends 4*a* of the individual electrodes 4 is not particularly limited. The first ends 4*a* of the individual electrodes 4 may be disposed at intervals such that properly sized intervals G are formed between adjacent pairs of variable electric potential regions H. Note that one fixed electric potential region C is defined as a non-heat generating region on the heating resistor 5 which has a projection 3*c* disposed on either side thereof.

Note also that the effects of the thermal printhead according to this embodiment are identical to those of the first embodiment.

4. Fourth Embodiment

Figure 7:
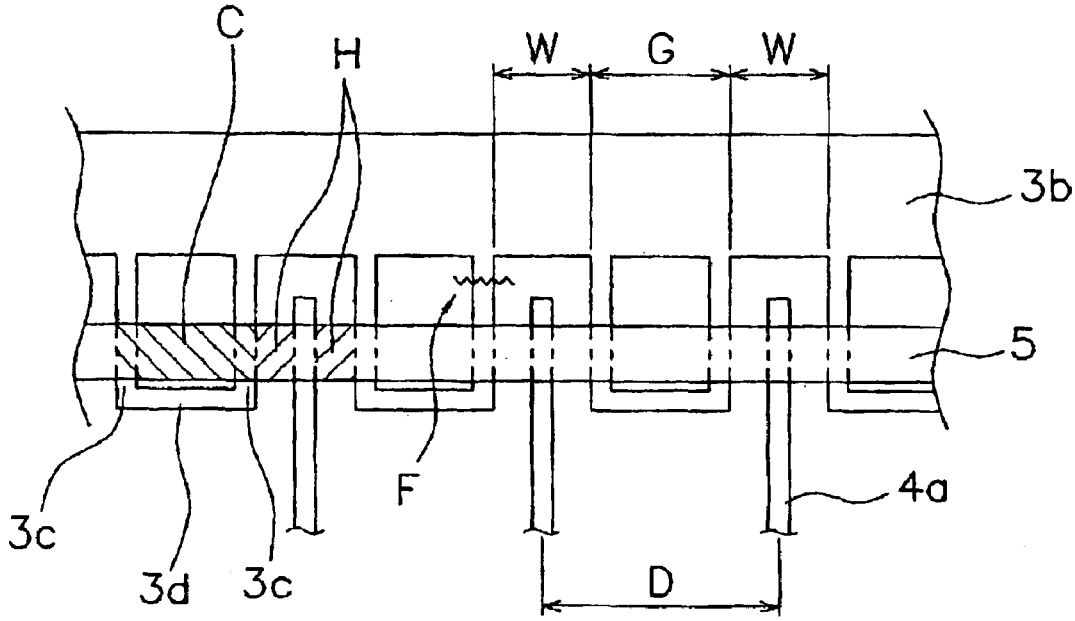
FIG. 7 shows the structure of a thermal printhead according to a fourth embodiment of the present invention.

FIG. 7 shows some of the elements of a thermal printhead according to a fourth embodiment of the present invention. The thermal printhead according to this embodiment has a structure that is identical with that of the first embodiment, except for the shape of the common electrode 3. More specifically, the common electrode 3 in the present embodiment is shaped such that bridges 3*d* connect each pair of projections 3*c* that are disposed between the first ends 4*a* of the individual electrodes 4.

Although each bridge 3*d* connects the ends of two projections 3*c* in FIG. 7, they are not limited to this position. For example, each bridge 3*d* may connect the middle portions of the projections 3*c*. In addition, each bridge 3*d* may be in electrical contact with the heating resistor 5. Furthermore, each bridge 3*d* may be formed such that it diagonally intersects with the heating resistor 5.

Providing the bridges 3*d* allow the fixed electric potential regions C to be formed without any difficulty, even in situations in which a projection 3*c* has been cut somewhere along its length. In other words, even if one projection 3*c* is broken at a position F shown in FIG. 7, the portion of the projection 3*c* after this break can still connect with the other projection 3*c* by means of the bridge 3*d*. Thus, a fixed electric potential region C that has a projection 3*c* on either side thereof can be formed on the heating resistor 5 without any difficulty.

Bridges which connect the projections 3*c* can also be provided in the thermal printheads according to the second and third embodiments of the present invention. Note also that the operation of the thermal printhead according to this embodiment is identical to those of the first embodiment. In addition, the durability of this thermal printhead will increase because it will be difficult for a fracture in the common electrode 3 to have any impact.

5. Fifth Embodiment

Figure 8:
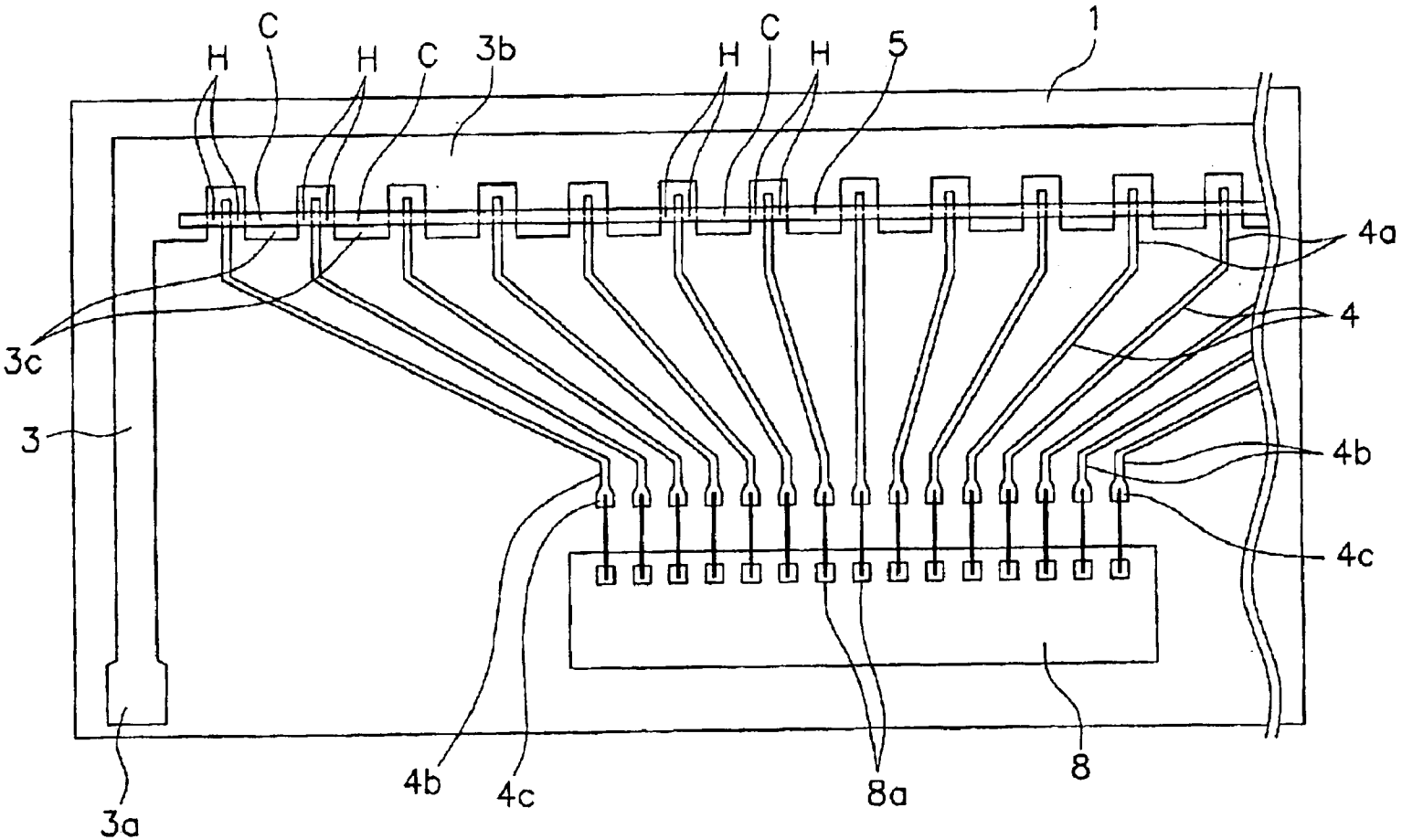
FIG. 8 shows the overall structure of a thermal printhead according to a fifth embodiment of the present invention.
Figure 9:
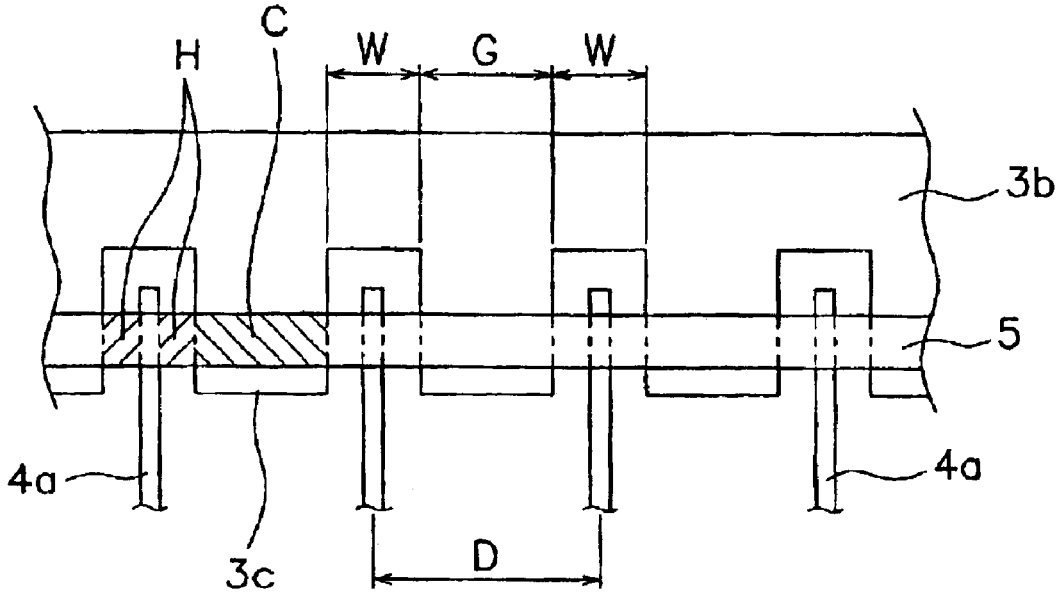
FIG. 9 shows details of the thermal printhead shown in FIG. 8.

FIG. 8 shows the overall structure of a thermal printhead according to a fifth embodiment of the present invention, and FIG. 9 shows some of the details thereof. The thermal printhead according to the fifth embodiment has a structure that is identical with that of the first embodiment, except for the shape of the common electrode 3 and the intervals at which the individual electrodes 4 are disposed.

The width of each projection 3*c* is formed to be wider than the width of each individual electrode 4. Each projection 3*c* intersects with and is in electrical contact with the heating resistor 5 at a plurality of points thereon. The portions of the projections 3*c* that contact with the heating resistor 5 are each fixed electric potential regions C. The electrical resistance of the common electrode 3 will be reduced, and the pattern for the common electrode will be easier to form, because each of the projections 3*c* have a wide width.

Like in the first embodiment, the regions on the heating resistor 5 which have a projection 3*c* on both sides thereof and a first end 4*a* of a individual electrode 4 that intersects therewith are variable electric potential regions H which form one dot. Each individual electrode 4 is disposed between a pair of projections 3*c*, and one projection 3*c* is disposed between each pair of first ends 4*a* of the individual electrodes 4. The interval D between each pair of first ends 4*a* is fixed.

As noted above, the interval G between the variable electric potential regions H, i.e., the width of each projection 3*c* of the common electrode 3, should be fixed so that there is enough width between the variable electric potential regions H to reduce the thermal impact they have on each other. In addition, the width W of each variable electric potential region H is set so that the entire portion of each variable electric potential region H will be at or above the temperature Tp1, even when a two-color (black and red) thermo-sensitive paper is used as a recording medium. Here, the temperature Tp1 Is the temperature at which, for example, a black image is generated and a red image is not generated.

A thermal printhead with this structure is operated in the same manner as that described in the first embodiment. In addition, the electrical resistance of the common electrode 3 will be smaller than that of the first embodiment, and the pattern for the common electrode will be easier to form, because each of the projections 3*c* have a wide width.

6. Sixth Embodiment

Figure 10:
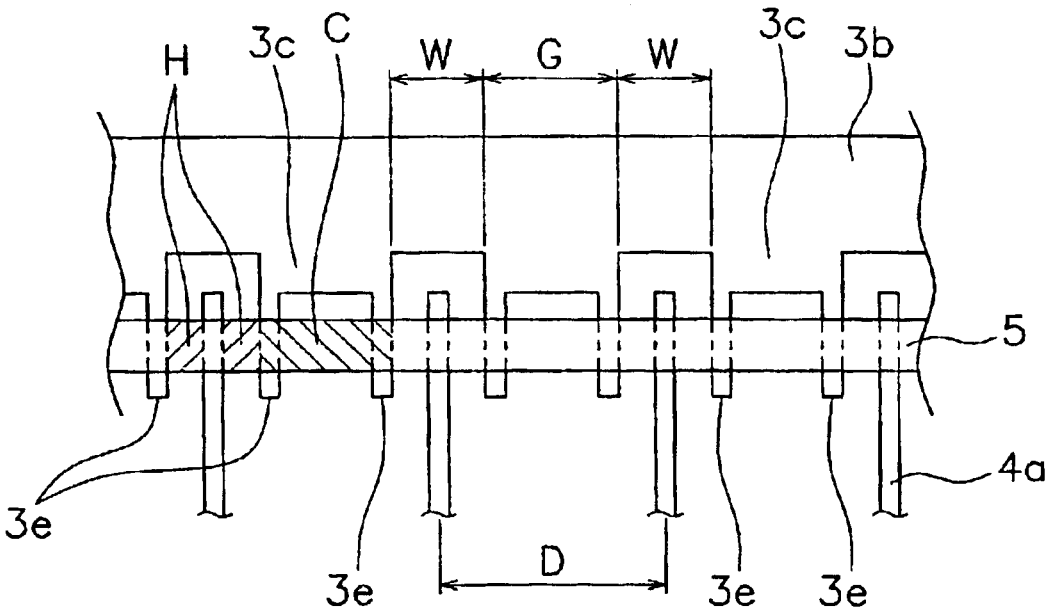
FIG. 10 shows the structure of a thermal printhead according to a sixth embodiment of the present invention.

FIG. 10 shows some of the elements of a thermal printhead according to a sixth embodiment of the present invention. The thermal printhead according to the sixth embodiment has a structure that is identical with that of the fifth embodiment, except for the shape of the projections 3*c* of common electrode 3. The projections 3*c* of the common electrode 3 are shaped such that the ends of each projection 3*c* in the fifth embodiment are branched into two branches 3*e*. Each branch 3*e* intersects with the heating resistor 5 and is in electrical contact therewith at the point in which it intersects. Each region of the heating resistor 5 that is disposed between two branches 3*e* is a fixed electric potential region C. Note that there are two branches 3*e* on each projection 3*c*, but that there can be three or more if so desired.

The resistance of the common electrode 3 can be made lower than that of the first embodiment, in which projections 3*c* having widths that are identical with the branches 3*e* project from the common line 3*b*, because the projections 3*c* of the common electrode 3 are branched in this embodiment. In addition, it will be easier to produce the pattern for the common electrode in this embodiment, and the electrical resistance thereof will be lower. This is because the common electrodes 3 have a wide width up to the point in which the projections 3*c* branch.

Like in the fifth embodiment, each first end 4*a* of the individual electrodes 4 are disposed between a pair of projections 3*c* of the common electrode 3, and disposed between a pair of branches 3*e* of a projection 3*c*. The regions on the heating resistor which have a branch 3*e* on both sides thereof and an individual electrode 4 that intersects therewith are variable electric potential regions H.

A thermal printhead with this structure is operated in the same manner as that described in the first embodiment. In addition, the electrical resistance of the common electrode 3 will be smaller than that of the first embodiment.

7. Seventh Embodiment

Figure 11:
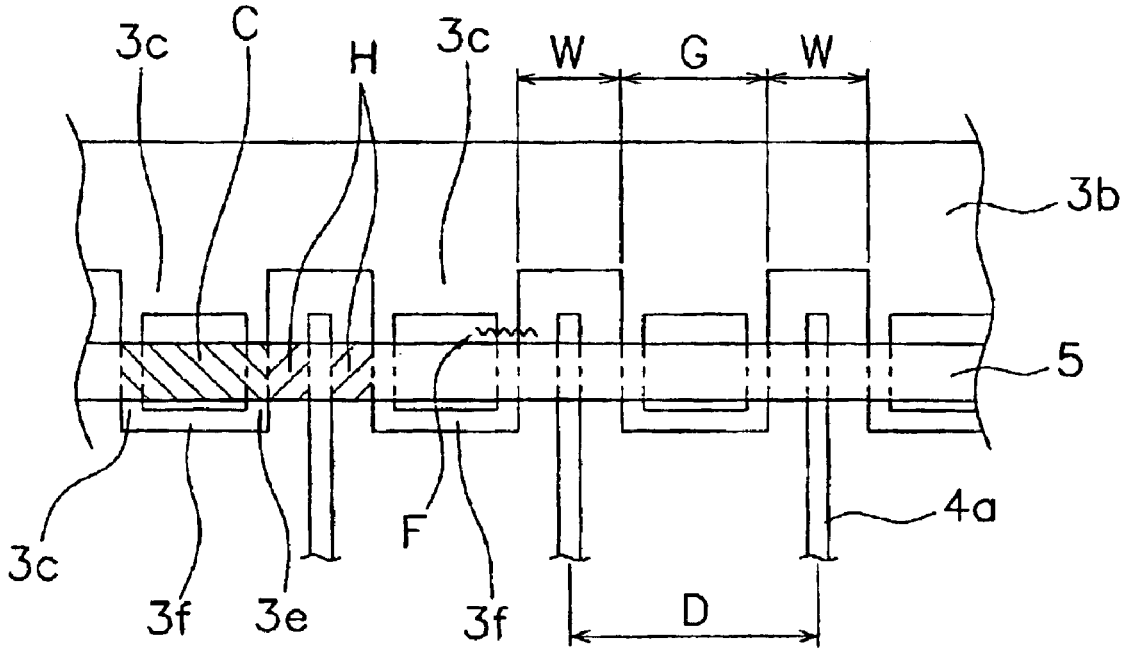
FIG. 11 shows the structure of a thermal printhead according to a seventh embodiment of the present invention.

FIG. 11 shows some of the elements of a thermal printhead according to a seventh embodiment of the present invention. The thermal printhead according to this embodiment has a structure that Is identical with that of the first embodiment, except for the shape of the common electrode 3. The common electrode 3 in the present embodiment is formed such that bridges 3*f* connect each pair of branches 3*e* that branch from each projection 3*c*. In other words, in the present embodiment, the end of each projection 3*c* of the common electrode 3 branches, and each branch 3*e* intersects with and is in electrical contact with the heating resistor 5. The end of each branch 3*e* is connected by a bridge 3*f*. Note that the bridges 3*f* are not necessarily limited to connecting the ends of the branches 3*e*, and each bridge 3*f* may connect the middle portions of the branches 3*e*. In addition, each bridge 3*f* may be in electrical contact with the heating resistor 5. Furthermore, each bridge 3*f* may be formed such that it diagonally intersects with the heating resistor 5.

By connecting the branches 3*e* of the common electrode 3 with the bridges 3*f*, the fixed electric potential regions C can be formed without any difficulty, even if one branch 3*e* is broken at a position F like that shown in FIG. 11. In other words, even if one branch 3*e* is cut at a position F shown in FIG. 11, the portion of the branch 3*e* after this break can still connect with the other branch 3*e* by means of the bridge 3*f*. Thus, a fixed electric potential region C that has a branch 3*e* on either side thereof can be formed on the heating resistor 5 without any difficulty.

Note also that the operation of the thermal printhead according to this embodiment is identical to that of the first embodiment. In addition, the durability of this thermal printhead will increase because, as noted above, it will be difficult for a fracture in the common electrode 3 to have any impact.

8. Eighth Embodiment

Figure 12A:
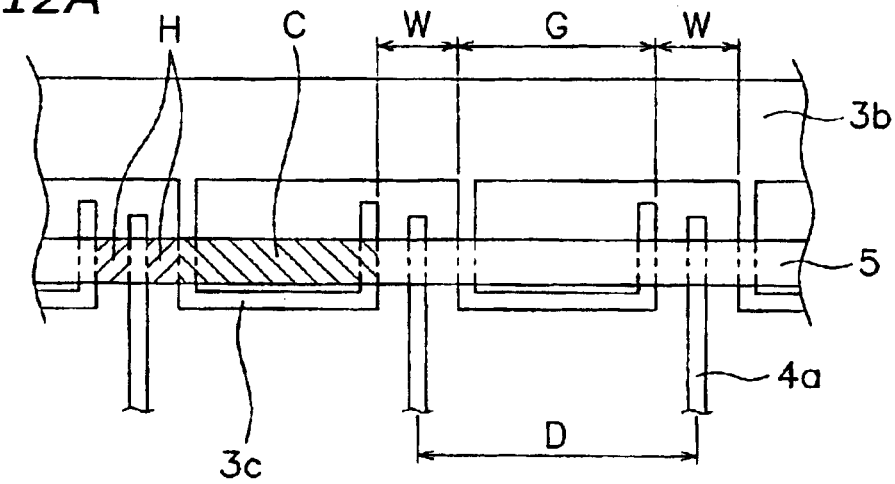
FIG. 12(*a*) shows the structure of a thermal printhead according to an eighth embodiment of the present invention.
Figure 12B:
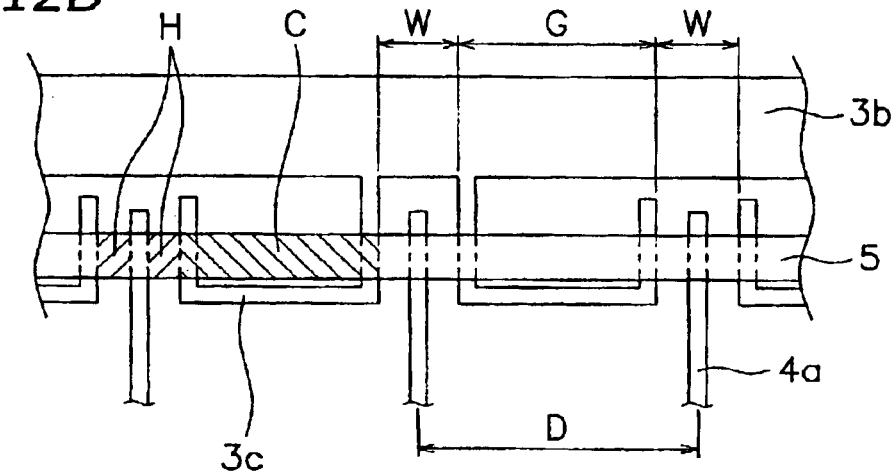
Figure 12C:
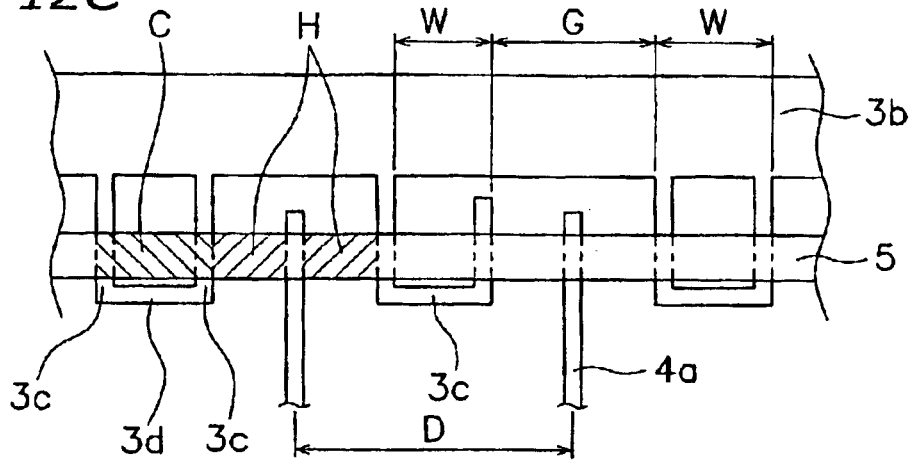

FIGS. 12(*a*), (*b*) show the structure of some of the essential elements of a thermal printhead according to an eighth embodiment of the present invention. The thermal printhead according to this embodiment has a structure that is identical with that of the first embodiment, except for the shape of the common electrode 3. The projections 3*c* of the common electrode 3 in this embodiment are non-linear. Each non-linear projection 3*c* intersects with the heating resistor 5 at a plurality of points and is in electrical contact therewith at the points in which it intersects. Each region of the heating resistor 5 that is disposed between the points in which each projection 3*c* contacts therewith is a fixed electric potential region C. FIG. 12(*a*) shows an example in which the projections 3*c* of the common electrode 3 have an approximate U shape, with each projection 3*c* extending in the same direction. FIG. 12(*b*) shows an example in which the projections 3*c* of the common electrode 3 have an approximate U shape, with each projection 3*c* extending in a mutually different direction. By forming the projections 3*c* in a non-linear pattern as shown in FIGS. 12(*a*), (*b*), it will be difficult for the heat generated by the variable electric potential regions H to escape to the common electrode 3, thus allowing the amount of energy consumed by the thermal printhead to be reduced.

In FIGS. 12(*a*), (*b*), each individual electrode 4 is disposed between a pair of projections 3*c*. The regions on the heating resistor 5 which have a projection 3*c* on both sides thereof and a first end 4*a* of an individual electrode 4 that intersects therewith are variable electric potential regions H. In this example, each variable electric potential region H corresponds to one dot, and is disposed between a pair of fixed electric potential regions C.

FIG. 12(*c*) shows a common electrode having two patterns of projections 3*c*. In this example, one pattern is a non-linear projection 3*c*, and the other pattern is one in which bridges 3*d* connect the projections 3*c*. Each individual electrode 4 is disposed between a non-linear projection 3*c* and a projection 3*c* that is connected by a bridge 3*d*.

As shown above, the common electrode 3 may be shaped such that the projections 3*c* intersect with and contact the heating resistor 5 at a plurality of points thereon. Note however that the shape of the projections 3*c* is not limited to that described above. In addition, a combination of patterns can be combined in one thermal printhead to form the common electrode 3.

Note also that the operation of the thermal printhead according to this embodiment is identical to that of the first embodiment.

9. Ninth Embodiment

Figure 13A:
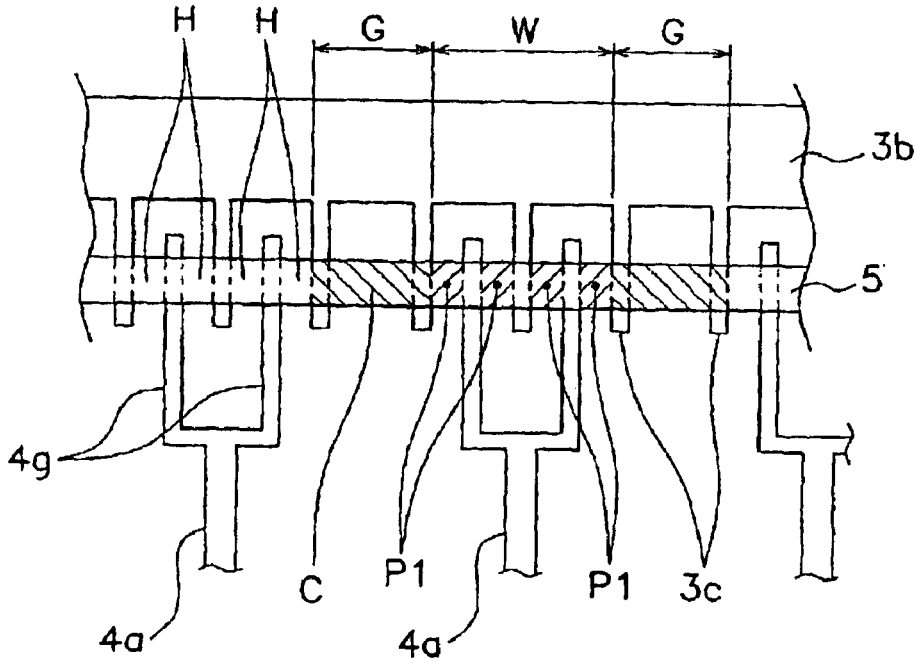
FIG. 13(*a*) shows the structure of a thermal printhead according to a ninth embodiment of the present invention.
Figure 13B:
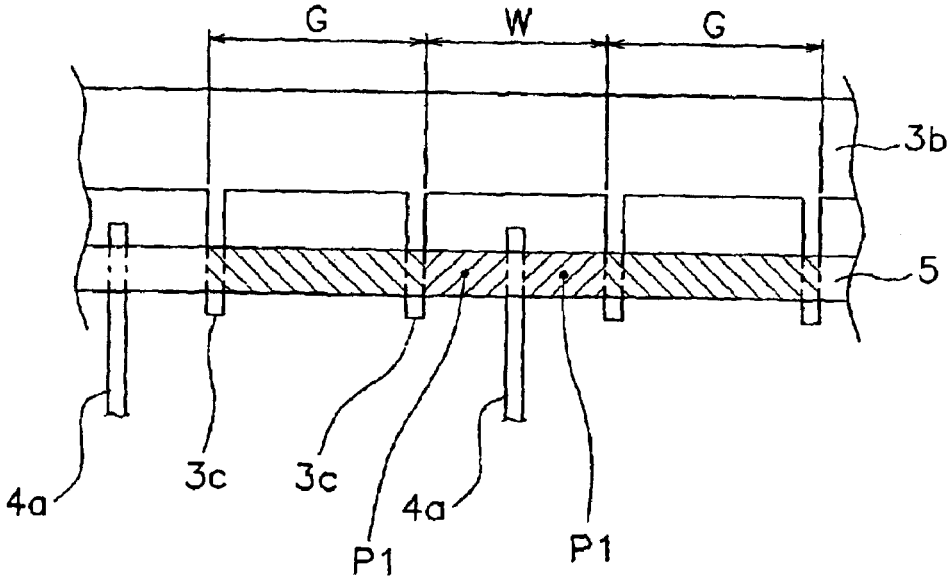
Figure 13C:
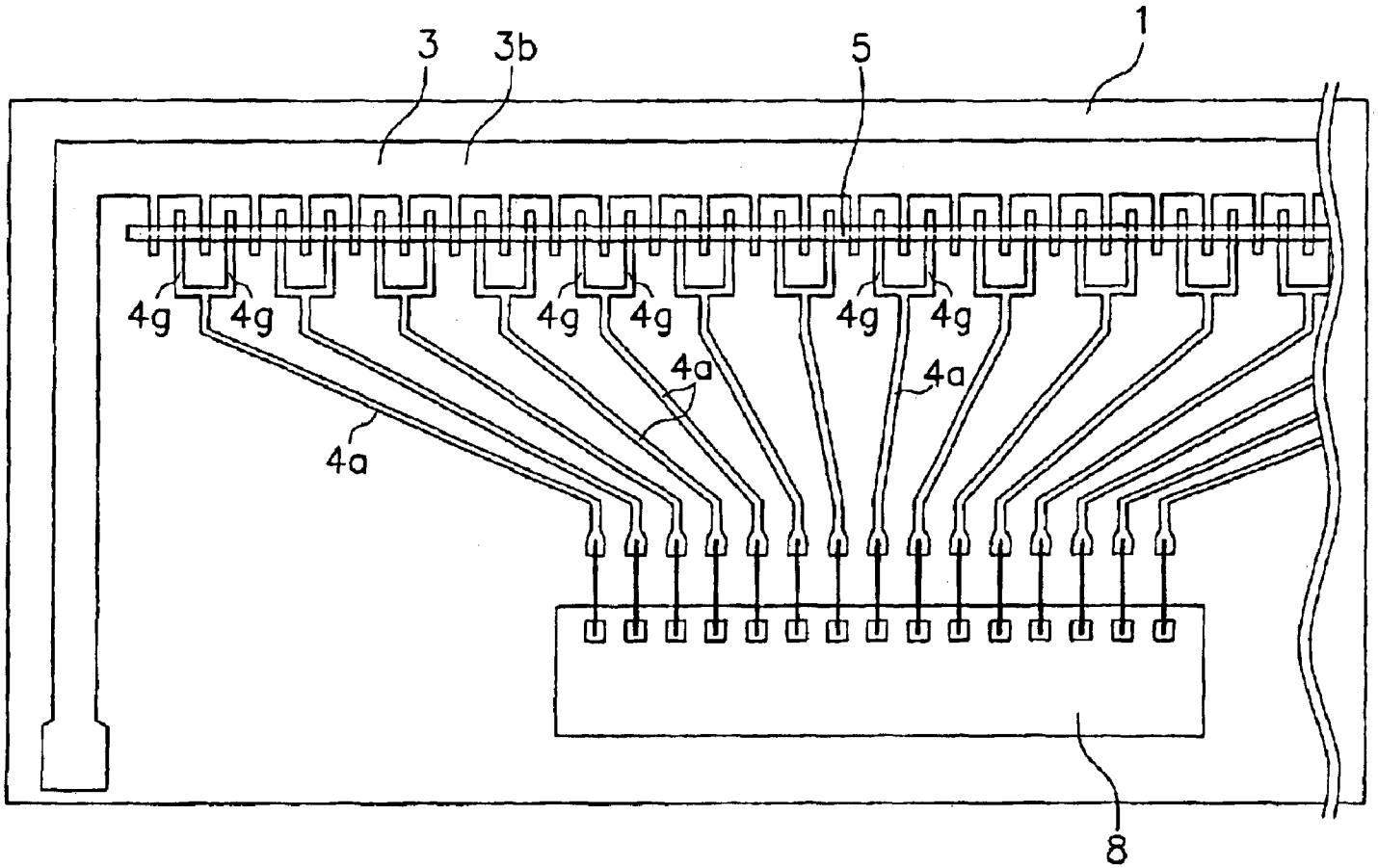

In FIG. 13(*a*), a thermal printhead according to a ninth embodiment of the present invention has a structure that is identical with that of the first embodiment, except for the shape of the individual electrodes 4. The first ends 4*a* of each individual electrode 4 are branched to form branches 4*g*. Each branch 4*g* intersects with the heating resistor 5, and is in electrical contact therewith at the points in which it intersects. The regions on the heating resistor 5 which have a projection 3*c* on both sides thereof and the branches 4*g* of an individual electrode 4 that intersect therewith are variable electric potential regions H. In this example, two variable electric potential regions H correspond to one dot because the first end 4*a* of each individual electrode 4 is branched into two branches 4*g*. There are at least two projections 3*c* disposed between each pair of variable electric potential regions H.

If the width W of one dot is the same, it is preferable that there be more than one variable electric potential region H included therein. For example, in FIGS. 13(*a*) and 13 (*b*), the width W of one dot is the same. However, in FIG. 13(*a*), 2 variable electric potential regions H form one dot. In this situation, the portions P1 that are the hottest points on the variable electric potential region H are disposed at four different locations within one dot. On the other hand, in FIG. 13(*b*), one variable electric potential region H forms one dot. Accordingly, there are only two different locations within one dot where the hot points P1 on the variable electric potential region H are disposed. Having one dot that has 4 hot points P1 therein means that the portion of the heating resistor 5 that corresponds to one dot will have a more uniform temperature distribution. Moreover, when using a two-color thermo-sensitive paper as a recording medium, the generation of colors other than those intended can be easily prevented by having a uniform temperature distribution on the regions of the heating resistor 5 that correspond to one dot.

Note also that the thermal printhead according to the ninth embodiment can be modified as shown in FIG. 13(*c*). The thermal printhead disclosed in FIG. 13(*c*) is identical to that disclosed in FIG. 13(*a*), except that the fixed electric potential regions C disposed between each pair of variable electric potential regions H have been eliminated.

10. Tenth Embodiment

Figure 14A:
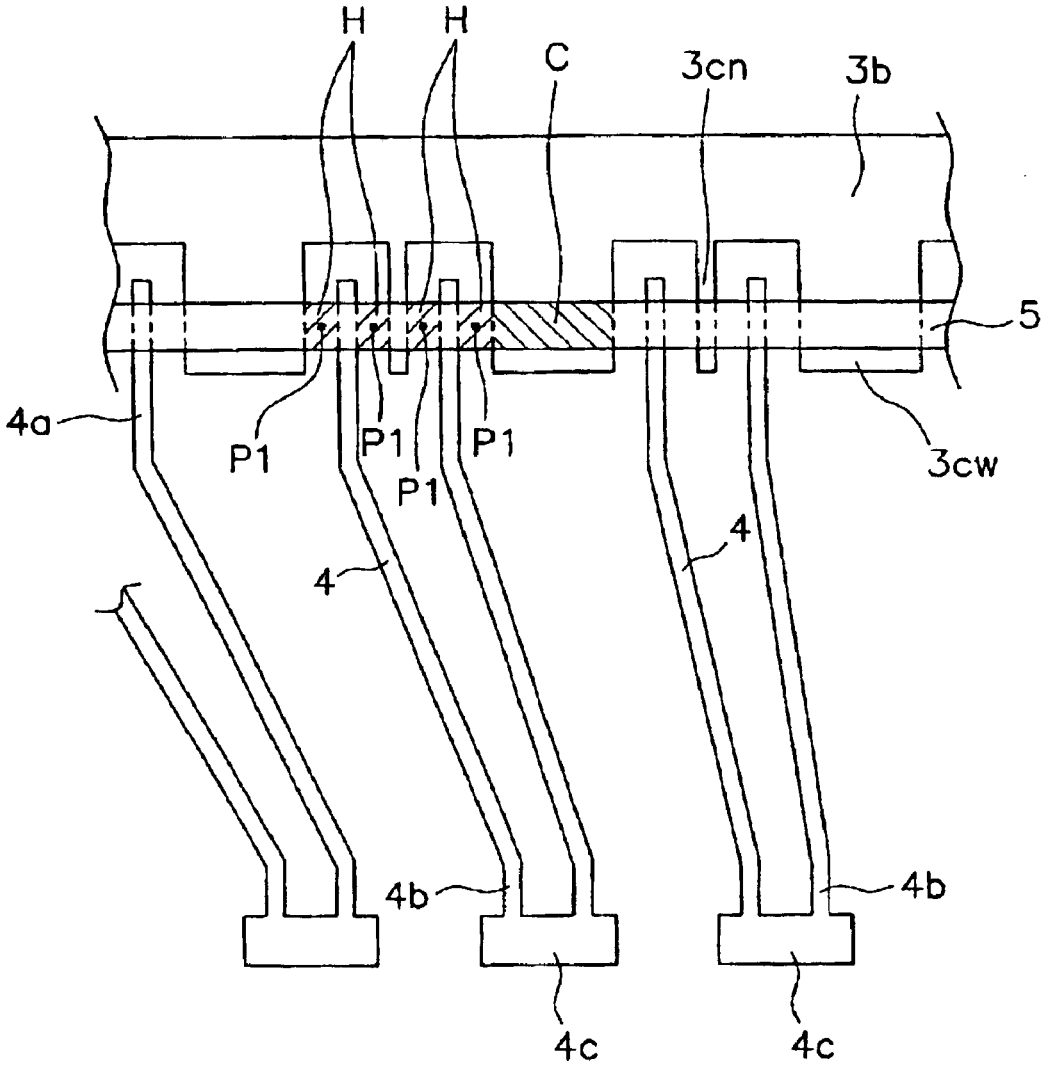
FIG. 14(*a*) shows the structure of a thermal printhead according to a tenth embodiment of the present invention.
Figure 14B:
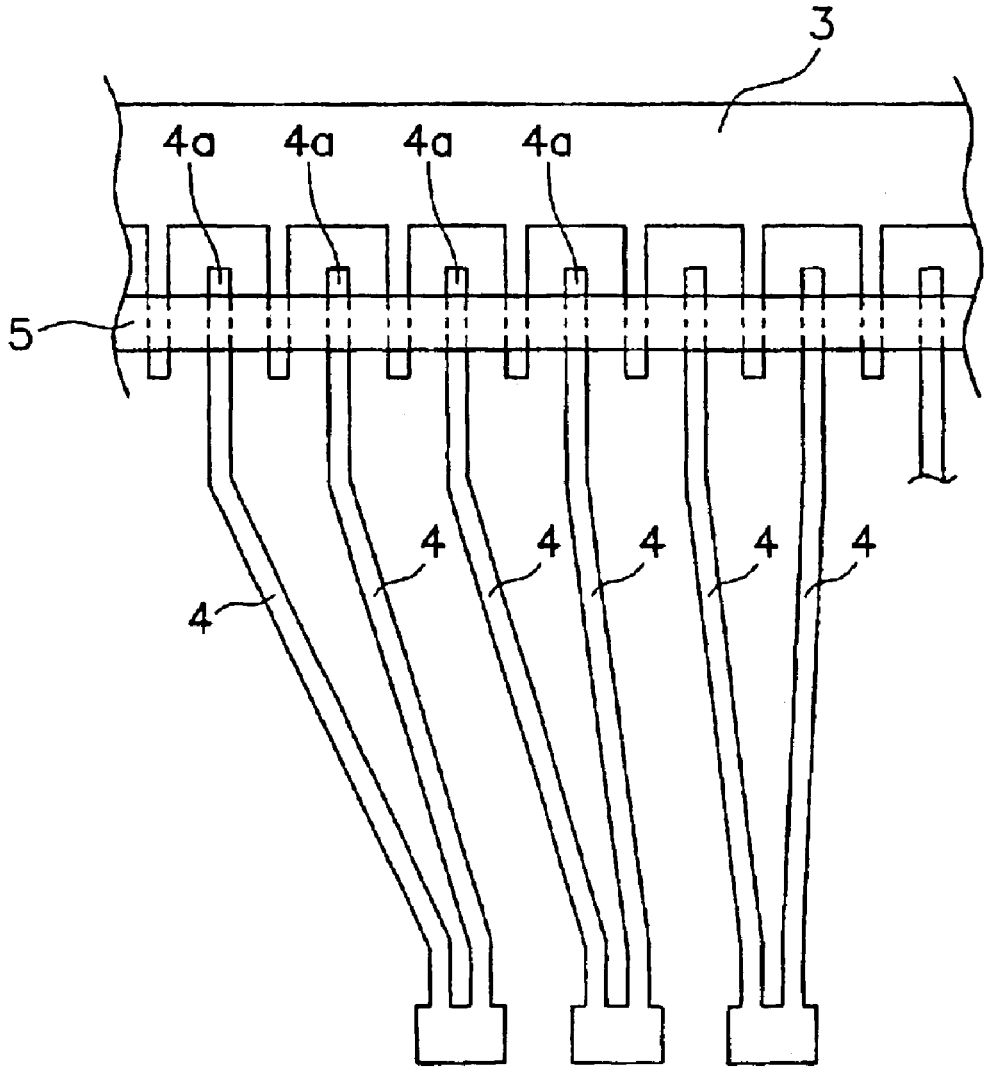

In FIG. 14(*a*), a thermal printhead according to a tenth embodiment of the present invention has a structure that is identical with that of the first embodiment, except for the shape of the common electrode 3 and the disposition of the individual electrodes 4. In this example as well, it is easy to make the temperature distribution of the portions of the heating resistor 5 that form one dot more uniform because a plurality of variable electric potential regions H form one dot.

A plurality of projections 3*cw* having a wide width and a plurality of projections 3*cn* having a narrow width sequentially project from the common line 3*b* of the common electrode 3. Each projection 3*c* intersects with the heating resistor 5, and is in electrical contact with the heating resistor 5 at the point in which it intersects. The portions of the wide projections 3*cw* that contact with the heating resistor 5 are the fixed electric potential regions C.

Each first end 4*a* of the individual electrodes 4 is disposed between a wide projection 3*cw* and a narrow projection 3*cn*. The regions on the heating resistor 5 which have a first end 4*a* of an individual electrode 4 on one side thereof and a projection of the common electrode 3 on the other side thereof are variable electric potential regions H. A pair of individual electrodes 4 that form two consecutive variable electric potential regions H are connected to the same terminal 4*c*. In other words, a pair of individual electrodes 4 that forms one dot is connected to a terminal 4*c*, so that a voltage can be turned on and off thereon simultaneously.

Note also that the thermal printhead according to the tenth embodiment can be modified as shown in FIG. 14(*b*). The thermal printhead disclosed in FIG. 14(*b*) is identical to that disclosed in FIG. 14(*a*), except that the fixed electric potential regions C disposed between each pair of variable electric potential regions H have been eliminated.

11. Eleventh Embodiment

Figure 15A:
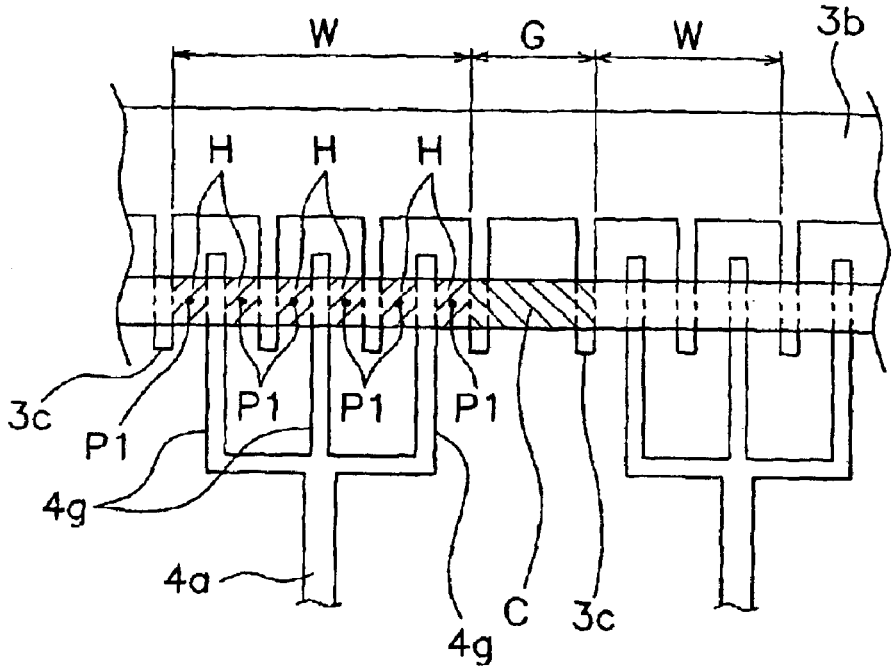
FIG. 15(*a*) shows the structure of a thermal printhead according to an eleventh embodiment of the present invention.
Figure 15B:
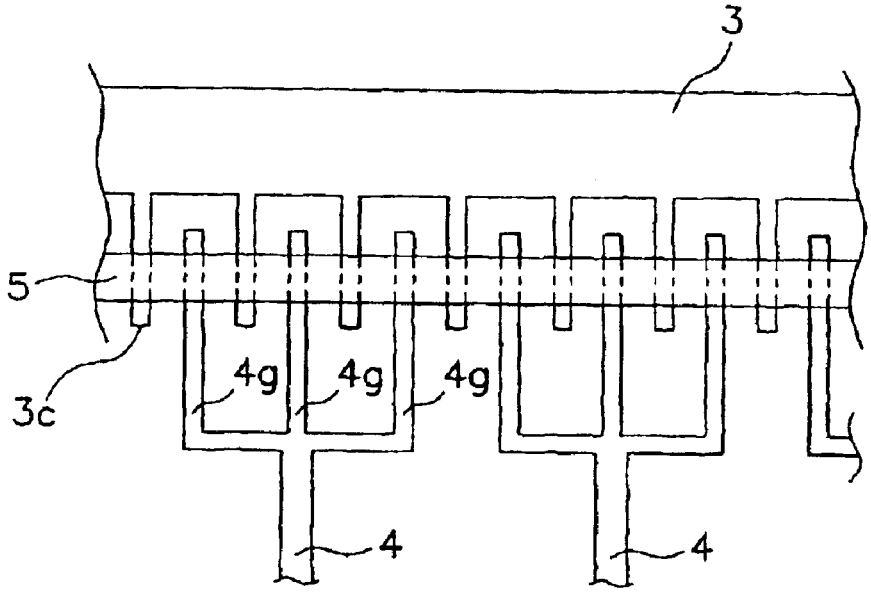
Figure 16:
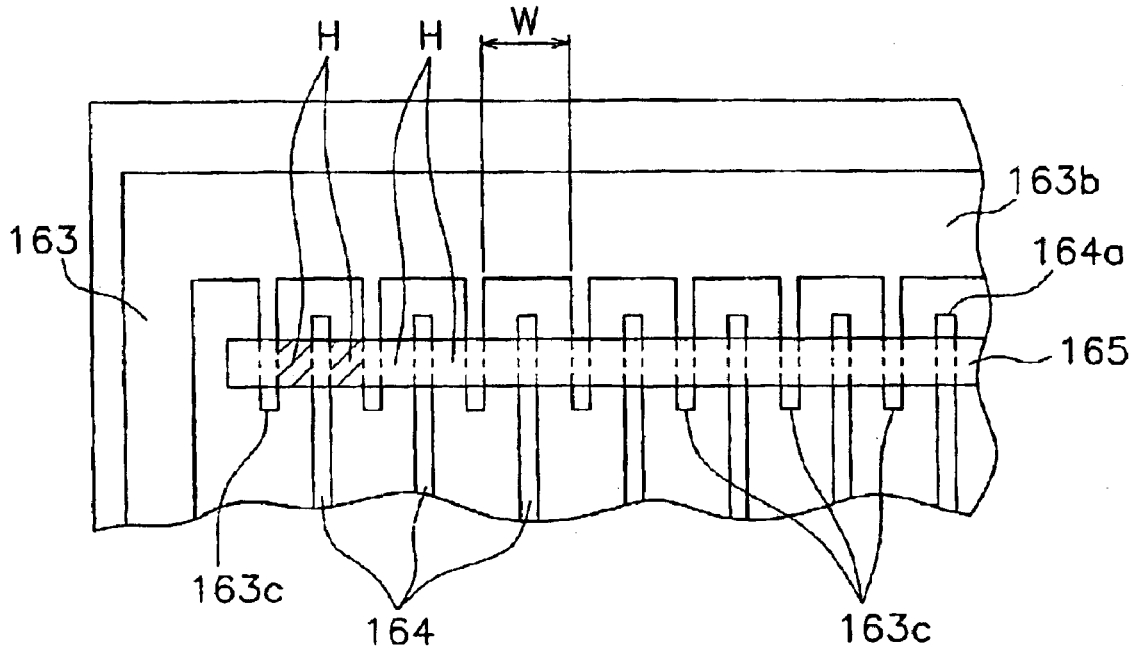
FIG. 16 shows the overall structure of a conventional thermal printhead.

FIG. 15(*a*) shows a thermal printhead according to an eleventh embodiment of the present invention, in which each first end 4*a* of the individual electrodes 4 have three branches. This thermal printhead has a structure that is identical with that of the first embodiment, except for the shape of the individual electrodes 4. In this example, three variable electric potential regions H form one dot, and there are thus 6 hot spots P1 within one dot.

Note also that the thermal printhead according to the eleventh embodiment can be modified as shown in FIG. 15(*b*). The thermal printhead disclosed in FIG. 15(*b*) is identical to that disclosed in FIG. 15(*a*), except that the fixed electric potential regions C disposed between each pair of variable electric potential regions H have been eliminated.

Note that the embodiments of the thermal printhead noted above are merely some examples thereof, and modifications that can be derived from these examples are included in the present invention. In addition, each embodiment noted above and modifications derived therefrom can be combined and used according to need.

This application claims priority to Japanese Patent Application No. 2002-36921. The entire disclosure of Japanese Patent Application No. 2002-369211 is hereby incorporated herein by reference.

The terms of degree such as substantially, about and approximately as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A thermal printhead used to print images on thermo-sensitive paper, comprising:

a substrate;

a belt shaped heat resistor disposed on top of the substrate;

a common electrode having a common line disposed along a longitudinal direction of the heat resistor, and a plurality of projections that each project from the common line and which intersect with and electrically contact with the heat resistor; and a plurality of individual electrodes that are each disposed between mutually adjacent projections and which intersect with and electrically contact with the heat resistor;

wherein a plurality of regions that have a substantially fixed electric potential are produced on the heating resistor in positions in which at least one variable electrical potential region is disposed therebetween when electric potential differences are produced between the individual electrodes and the projections of the common electrode; and each variable electric potential regions on the heating resistor is disposed between mutually adjacent projections and has one individual electrode that intersects therewith.

2. The thermal printhead set forth in claim 1, wherein temperatures of the variable electric potential regions are higher than the fixed electric potential regions when an electric potential difference is produced between the common electrode and the individual electrodes.

3. The thermal printhead set forth in claim 1, wherein each fixed electric potential region is sized such that the temperature of a variable electric potential region disposed on one side of a fixed potential region does not substantially affect the temperature of a variable electric potential region disposed on the other side thereof.

4. The thermal printhead set forth in claim 1, wherein the thermo-sensitive paper is a two-color thermo-sensitive paper that produces a first color at a temperature Tp1 or above, and produces a second color between a temperature Tp2 and the temperature Tp1 the temperature Tp2 lower than the temperature Tp1: and the variable electric potential regions are sized such that the entire portion of each region is at or above the temperature Tp1 when heated.

5. The thermal printhead set forth in claim 1, wherein portions of the heating resistor that are disposed between two adjacent projections are fixed electric potential regions.

6. The thermal printhead set forth in claim 5, wherein a bridge connects the projections on both sides of each fixed electric potential region.

7. The thermal printhead set forth in claim 1, wherein portions of the heating resistor that are in electrical contact with the projections of the common electrode are the fixed electric potential regions.

8. The thermal printhead set forth in claim 1, wherein each projection on the common electrode is in electrical contact with the heating resistor at a plurality of points thereon, and portions of the heating resistor which are disposed between the plurality of points are the fixed electric potential regions.

9. The thermal printhead set forth in claim 8, wherein the tip of each projection on the common electrode is branched;

each branch of each projection intersects with and is electrical contact with the heating resistor; and portions of the heating resistor that are disposed between the branches are the fixed electric potential regions.

10. The thermal printhead set forth in claim 9, wherein a bridge connects the branches on both sides of each fixed electric potential region.

11. The thermal printhead set forth in claim 8, wherein each projection on the common electrode is non-linear, and intersects with and is in electrical contact with the heating resistor at a plurality of points thereon; and portions of the heating resistor that are disposed between the plurality of points on the projections are the fixed electric potential regions.

12. The thermal printhead set forth in claim 1, wherein the individual electrodes are branched; and one projection is disposed between two branches of each individual electrode and intersects with and electrically contacts with the heating resistor.

13. A thermal printhead, comprising:

a substrate;

a belt shaped heat resistor disposed on top of the substrate;

a common electrode having a common line disposed along a longitudinal direction of the heat resistor, and a plurality of projections that each project from the common line and which intersect with and electrically contact with the heat resistor; and a plurality of individual electrodes that are each disposed between mutually adjacent projections and which intersect with and electrically contact with the heat resistor;

wherein a plurality of regions on the heat resistor are comprised of a plurality of heat generating regions that are electrically connected to the individual electrodes, and at least one non-heat generating region disposed between each pair of the plurality of heat generating regions and not electrically connected to the individual electrodes.

14. The thermal printhead as set forth in claim 13, wherein the plurality of projections are spaced apart from each other at a predetermined distance, and;

the plurality of heat generating regions and the plurality of non-heat generating regions are arranged on the heating resistor such that one heat generating regions alternates with one non-heat generating region.

15. The thermal printhead according to claim 13, wherein the heat generating regions and the non-heat generating regions have different widths.

16. The thermal printhead according to claim 13, wherein the plurality of heat generating regions and the plurality of non-heat generating regions are arranged on the heating resistor such that one heat generating region alternates with a plurality of non-heat generating regions.

17. A thermal printhead, comprising:

a substrate;

a belt shaped heat resistor disposed on top of the substrate;

a common electrode having a common line disposed along a longitudinal direction of the heat resistor, and a plurality of projections that each project from the common line and which intersect with and electrically contact with the heat resistor; and a plurality of individual electrodes that are each disposed between mutually adjacent projections and which intersect with and electrically contact with the heat resistor, each individual electrode comprising a first end, a second end, and a terminal disposed on the second end;

wherein the total number of terminals is less than the total number of first ends, and each terminal is electrically connected to two or more first ends that are electrically connected to mutually adjacent regions on the heat resistor.

18. The thermal printhead set forth in claim 17, wherein a plurality of first ends branch out from each individual electrode.

19. The thermal printhead set forth in claim 17, wherein mutually adjacent groups of the plurality of individual electrodes share one terminal.

* * * * *